US008292057B2

(12) United States Patent
Lennon

(10) Patent No.: US 8,292,057 B2
(45) Date of Patent: Oct. 23, 2012

(54) STEP BAND GUARD FOR A PASSENGER CONVEYOR

(75) Inventor: Paschal F. Lennon, Korneuburg (AT)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 13/347,010

(22) Filed: Jan. 10, 2012

(65) Prior Publication Data

US 2012/0103755 A1 May 3, 2012

Related U.S. Application Data

(62) Division of application No. 12/445,742, filed on Apr. 16, 2009, now Pat. No. 8,113,333.

(51) Int. Cl.
*B66B 21/02* (2006.01)

(52) U.S. Cl. ..... 198/326; 198/321; 198/324

(58) Field of Classification Search ..... 198/321–338
See application file for complete search history.

(56) References Cited

U.S. PATENT DOCUMENTS 5,291,982 A 3/1994 Saito et al.
5,511,647 A * 4/1996 Adrian et al. ..... 198/335
5,601,179 A 2/1997 Wente et al.
6,138,819 A 10/2000 Bogle et al.
2005/0217971 A1 * 10/2005 Kim ..... 198/338
2006/0096834 A1 5/2006 Illedits et al.

FOREIGN PATENT DOCUMENTS

GB 2135263 A 8/1984
JP 1247312 A 10/1989
JP 10279243 A 10/1998
JP 11060133 A 3/1999

OTHER PUBLICATIONS

International Search Report and Written Opinion of the International Searching Authority for International application No. PCT/US2006/060817 mailed Jul. 30, 2007.
International Preliminary Report on Patentability for International application No. PCT/US2006/060817 mailed May 28, 2009.

* cited by examiner

*Primary Examiner* — Leslie A Nicholson, III
(74) *Attorney, Agent, or Firm* — Carlson, Gaskey & Olds PC

(57) ABSTRACT

A step band guard for use of a passenger conveyor includes a first panel comprising a first piece of material. A second panel comprises a second piece of material that is distinct and separate from the first piece of material. A securing connection allows for selectively securing the panels together. The first panel can be strategically left in place for blocking access to at least a portion of a step band near a turnaround. The second panel can be selectively put in place when blocking access to the entire step band at the turnaround is desired. The first panel allows for some access to the step band and allows an individual to move the step band without having to have the entire step band guard in place.

4 Claims, 2 Drawing Sheets

STEP BAND GUARD FOR A PASSENGER CONVEYOR

CROSS REFERENCE TO RELATED APPLICATION

This is a divisional application of U.S. patent application Ser. No. 12/445,742 filed Apr. 16, 2009 now U.S. Pat. No. 8,113,333.

TECHNICAL FIELD

This invention generally relates to passenger conveyors. More particularly, this invention relates to a step band guard for use with passenger conveyors.

DESCRIPTION OF THE RELATED ART

Passenger conveyors such as escalators or moving walkways typically include a step band comprising a plurality of steps that follow a loop for moving passengers in a desired direction. At the ends of the loop, the step band follows a so-called turnaround. These portions of the step band are typically beneath a floor surface and hidden from view during normal passenger conveyor operation.

During maintenance procedures, for example, a landing floor panel is removed to expose the turnaround section of the step band. The conventional practice is to provide a step band guard at the turnaround location to protect an individual from coming into contact with moving parts of the step band during a maintenance procedure, for example.

There are times during assembly or maintenance procedures where an individual must be able to access components in the vicinity of the turnaround of the step band. During such times, an individual typically removes the step band guard to provide such access. Most often, the step band will not be moved when the step band guard is removed.

The typical step band guard configuration, which effectively blocks the entire turnaround portion of the step band, presents certain disadvantages and inefficiencies. For example, whenever the step band guard is removed to allow access to a component in the vicinity of the turnaround, the step band cannot be moved while the individual is standing in the turnaround area. Before the step band can again be moved, the individual must climb out of the access area. This adds additional time and inconvenience for a worker whether in a manufacturing facility or a location where the passenger conveyor is installed. For example, an individual working on an installed system typically has to remove the step band guard and climb out of an access area and move the step band to the desired position. The worker then climbs back into the access area and performs the desired task. The worker then climbs back out of the access area each time they want to move the step band and then climbs back in to continue the necessary tasks.

The same procedure occurs during a typical passenger conveyor, manufacturing or assembly operation. This introduces additional labor and time into the process.

SUMMARY

An exemplary step band guard for use with a passenger conveyor includes a first panel comprising a first piece. A second panel comprises a second piece that is distinct and separate from the first piece. A securing connection selectively secures the second panel in a desired position adjacent the first panel.

An exemplary passenger conveyor includes a step band comprising a plurality of steps that are useful for carrying passengers in a desired direction. The step band follows a turnaround at two locations. At least one of the locations includes a first step band guard panel comprising a first piece. A second panel comprises a second piece that is distinct and separate from the first piece. A securing connection selectively secures the second panel in a desired position adjacent the first panel so that the first and second panels together provide a barrier for blocking access to the step band at the turnaround.

An exemplary method of using a step band guard in a position for blocking access to a passenger conveyor step band at a turnaround includes removing the second panel from the position while leaving the first panel in the position such that at least the first panel at least partially blocks access to the step band near the turnaround.

The various features and advantages of this invention will become apparent to those skilled in the art from the following detailed description. The drawings that accompany the detailed description can be briefly described as follows.

DETAILED DESCRIPTION

Figure 1:
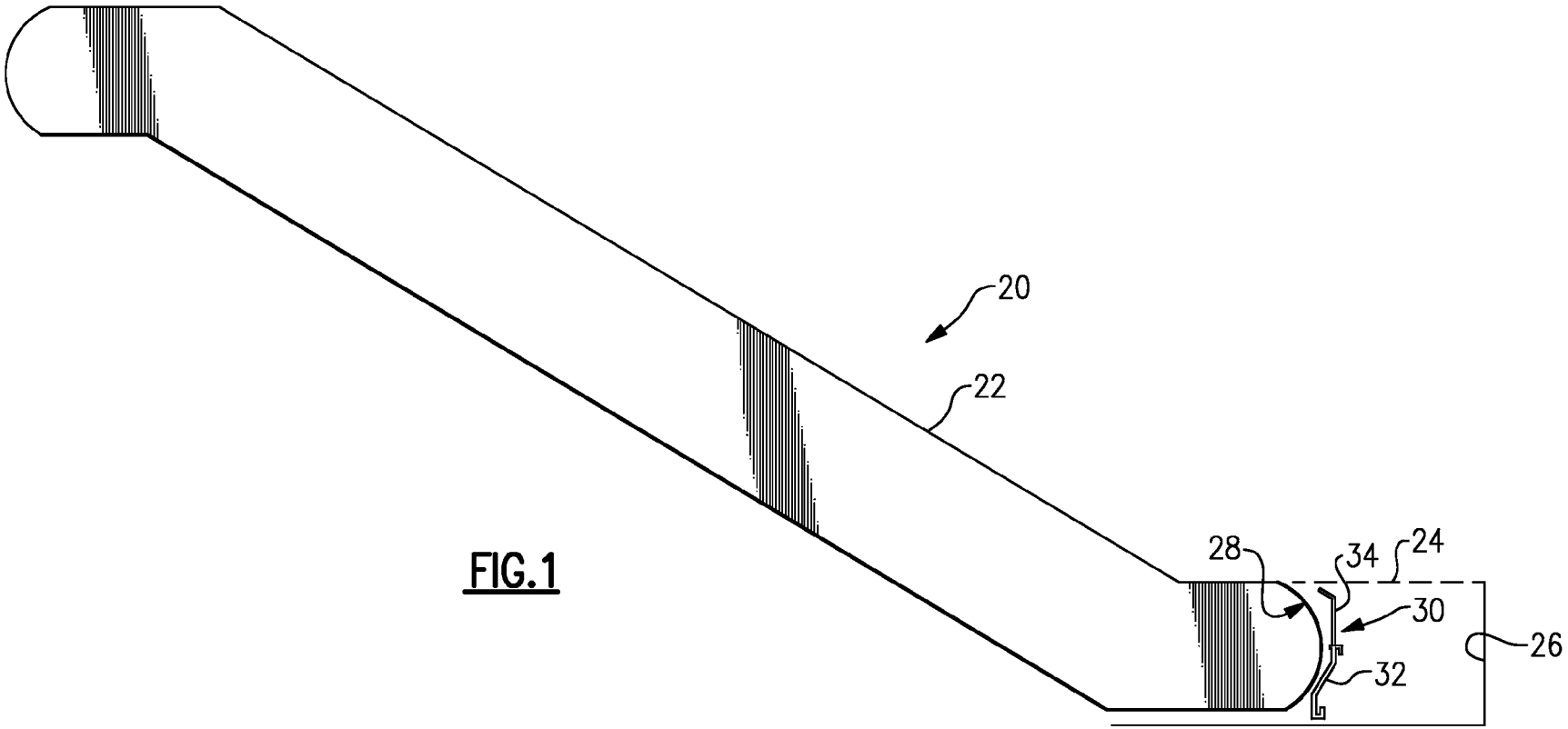
FIG. 1 schematically illustrates selected portions of a passenger conveyor assembly including a step band guard designed according to an embodiment of this invention.

FIG. 1 schematically shows selected portions of a passenger conveyor 20. In this example, the passenger conveyor 20 comprises an escalator. A step band 22 is schematically shown, which moves in a known manner for carrying passengers in a desired direction.

Near a lower end of the example step band 22 a landing 24 is associated with a floor surface. A work area 26 is recessed below the floor and provides access to a turnaround 28 where the step band 22 reverses direction as it follows the illustrated path.

A step band guard 30 blocks access to the step band 22 at the turnaround 28. The example step band guard 30 includes a first panel 32 comprising a first piece of material. A second panel 34 comprises a second piece of material that is distinct and separate from the first piece of material. The material of each piece is the same in one example. In another example the panels comprise different materials.

The first panel 32 and the second panel 34 are secured together so that the two of them effectively cover the height of the step band 22 at the turnaround 28 to prevent contact between an individual in the work area 26 and a portion of the step band 22 at the turnaround 28.

The illustrated step band guard 30 is secured into a desired position where it blocks access to the step band by being connected to a portion of a known frame associated with the step band 22. In one example, the portion of the frame is configured to support a conventional step band guard and the example step band guard 30 is designed to cooperate with such a known frame portion.

Figure 3:
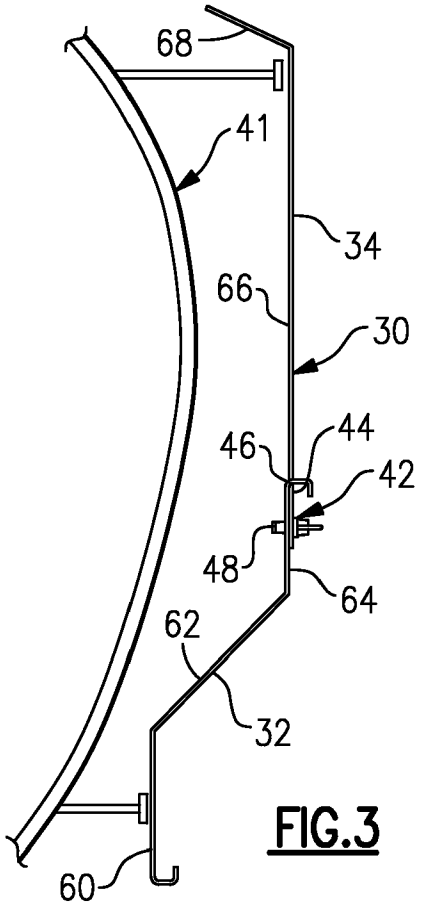
FIG. 3 is a side view of the embodiment of FIG. 2.
Figure 2:
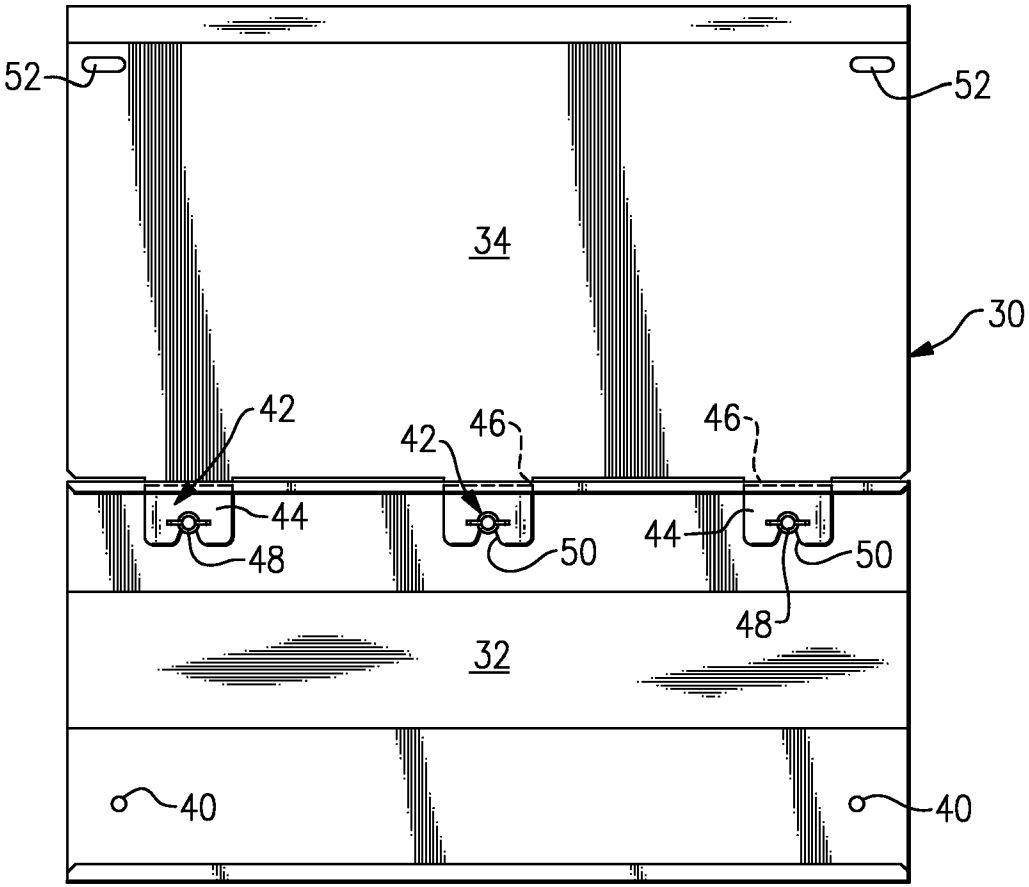
FIG. 2 is an illustration of an example embodiment of a step band guard.

FIGS. 2 and 3 show another example step band guard 30. In this example, the first panel 32 and the second panel 34 have a contour, which is best appreciated from FIG. 3, that facilitates positioning the step band guard 30 close to a step band at a turnaround generally corresponding to the path of the step band at the turnaround. In this example, the contour includes a first portion 60 near a bottom (according to the drawing) of the first panel 32 that is oriented vertically. A second, next portion 62 is at an oblique angle to the first portion 60. A next adjacent third portion 64 is generally parallel to the first portion 60. In the illustrated example, the first, second and part of the third portions 60, 62 and 64 are established by the first panel 32.

A second section of the third portion in this example is part of the second panel 34. A fourth portion 68 of the contour is near an opposite end of the guard 30 (e.g., near a top in the drawings). The fourth portion 68 is at an oblique angle to the third portion 64, 66. In this example, the oblique angles of the second portion 62 and the fourth portion 68 are approximately equal.

In one example, the first panel 32 has a height of approximately 393 mm and the second panel 34 has a height of approximately 482 mm so that the two panels together essentially cover or extend along the entire height of the step band at a turnaround.

In one example, each of the panels 32 and 34 comprise a sheet of steel having an anticorrosive coating. One example includes a zinc coating. Given this description, those skilled in the art will be able to select an appropriate material and thickness to provide a desired level of rigidity for the step band guard 30.

Having separate and distinct pieces of material for the first panel 32 and the second panel 34, respectively, allows for selectively installing one or both of the panels in a position to block access to a step band. The example first panel 32 includes mounting holes 40 that are configured to at least partially receive mounting members such as fasteners for securing the first panel 32 to a frame portion of a passenger conveyor near a turnaround. One example includes bolts and wing nuts as the fasteners that allow for manually installing the first panel 32 in a position for blocking access to a corresponding portion of the step band at a turnaround.

One advantage to this example is that the first panel 32 may be installed once in a manufacturing facility and remain in place during an assembly procedure. The fact that the first panel 32 does not block access to the entire turnaround portion of the step band allows for sufficient access to complete many assembly tasks. At the same time, the first panel 32 provides some protection to an individual at the location of the turnaround so that the step band may be moved to facilitate further steps in an assembly process. Therefore, this example provides significant time and cost saving advantages during a manufacturing or assembly process.

The first panel 32 of the illustrated example also provides the advantage of selectively blocking access to a step band at a turnaround of an installed conveyor within a working area such as the working area 26 of FIG. 1. In one example, the first panel 32 is configured to be up to approximately knee-height of an individual when the first panel 32 is installed in a position to block access to the corresponding portion of the step band at the turnaround. In many circumstances, this amount of blocking is sufficient to allow an individual to move the step band while protecting the individual from undesired contact with the moving parts. At the same time, the reduced height of the first panel 32 compared to the combined height of the entire step band guard 30 allows for limited access to the step band at the turnaround. Therefore, the illustrated example allows an individual to remove the second panel 34 once and to perform a series of tasks during a maintenance procedure including moving the step band, for example, without having to remove the first panel 32 and without having to repeatedly replace and remove the second panel 34. Therefore, this example provides significant time and cost savings advantages compared to previous, one-piece step band guards.

When it is desirable to have the entire step band guard 30 in place, the example of FIGS. 2 and 3 includes a securing connection 42 for securing the second panel 34 in a desired position adjacent the first panel 32. The example securing connection 42 includes a plurality of tabs 44, which in this example are formed as part of the second panel 34. The tabs 44 are at least partially received through slots 46, which in this example are formed in the first panel 32. When the tabs 44 are positioned against a corresponding portion of a surface on the first panel 32, fasteners 48 secure the two panels together.

In this example, a plurality of tabs 44 and a corresponding plurality of slots 46 are used. Each of the example tabs 44 includes a slot 50 for lowering the tabs 44 through the slots 46 and over the fasteners 48 that are already supported on the first panel 32. In the illustrated example, the fasteners 48 comprise bolts and wing nuts that allow for manually, selectively securing the second panel 34 together with the first panel 32.

In one example use of the illustrated step band guard 30, the second panel 34 is selectively removed from the position where it blocks access to the step band guard at the turnaround. At the same time, the first panel 32 is left remaining in the blocking position. Another advantage to such an arrangement is that an individual need not lift the weight of the entire step band guard 30 but only need lift the second panel 34. This allows an individual to lift approximately half the weight as may otherwise be required where an entire, single-piece step band guard must be entirely removed to provide access to the step band.

Both panels can be removed as desired.

In the illustrated example, the second panel 34 includes openings 52 that are adapted to receive mounting members such as bolts for further securing the step band guard 30 in a desired position relative to a step band. In one example, the openings 52 receive bolts that are associated with a known frame portion otherwise used for supporting a traditional step band guard. Accordingly, the illustrated example can be retrofit into an existing passenger conveyor system in place of a traditional, one-piece step band guard.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A method of using a step band guard having a first panel and a second panel that is distinct and separate from the first panel, comprising:

removing the second panel from a position within a work space recessed below a floor where the second panel blocks access to at least a portion of a step band near a turnaround of the step band; and leaving the first panel in a position within the work space for blocking access to another portion of the step band at the turnaround.

2. The method of claim 1, comprising moving the step band with only the first panel in the position.

3. The method of claim 1, comprising positioning the second panel above the first panel prior to the removing.

4. The method of claim 1, comprising securing the first and second panels together prior to the removing; and separating the second panel from the first panel during the removing.

* * * * *